US012577745B2

(12) United States Patent
Salis et al.

(10) Patent No.: US 12,577,745 B2
(45) Date of Patent: Mar. 17, 2026

(54) SNOW GROOMER VEHICLE AND METHOD OF CONTROLLING A SNOW GROOMER VEHICLE

(71) Applicant: PRINOTH S.p.A., Vipiteno (IT)

(72) Inventors: Francesco Salis, Vipiteno (IT); Martin Kirchmair, Vipiteno (IT); Richard Casartelli, Vipiteno (IT); Alberto Paoletti, Vipiteno (IT)

(73) Assignee: PRINOTH S.P.A. (IT)

( * ) Notice: Subject to any disclaimer, the term of this patent is extended or adjusted under 35 U.S.C. 154(b) by 685 days.

(21) Appl. No.: 17/925,245

(22) PCT Filed: May 17, 2021

(86) PCT No.: PCT/IB2021/054216
§ 371 (c)(1),
(2) Date: Nov. 14, 2022

(87) PCT Pub. No.: WO2021/229551
PCT Pub. Date: Nov. 18, 2021

(65) Prior Publication Data

US 2023/0228050 A1 Jul. 20, 2023

(30) Foreign Application Priority Data

May 15, 2020 (IT) ..... 102020000011272

(51) Int. Cl.
*E01H 4/02* (2006.01)

(52) U.S. Cl.
CPC ..... *E01H 4/02* (2013.01)

(58) Field of Classification Search
CPC .. E01H 4/00; E01H 4/02; B60K 28/02; B60K 28/06; B62D 55/06; B62D 55/065;
(Continued)

(56) References Cited

U.S. PATENT DOCUMENTS

2002/0156574 A1* 10/2002 Fortin ..... B62D 55/30 701/469
2020/0109532 A1* 4/2020 Betz ..... E01H 4/02
2022/0035320 A1* 2/2022 Tschinkel ..... E01H 4/00

FOREIGN PATENT DOCUMENTS

AT 500147 A1 11/2005
DE 10045524 A1 3/2002
(Continued)

*Primary Examiner* — Joseph M Rocca
*Assistant Examiner* — Robert E Pezzuto
(74) *Attorney, Agent, or Firm* — Aldo Noto, Esq.; Rimon PC

(57) ABSTRACT

A snow groomer vehicle includes an implement such as a blade and a tiller assembly, a first detection device configured to define data by processing areas of an environment behind the snow groomer; a satellite navigation device and/or a second detection device to define data by processing the areas of the environment in front of the snow groomer vehicle and framed by the second detection device; and a control system including a processing unit to process data from the satellite navigation device and/or the second detection device to define an objective map of a desired snow treatment. The processing unit defines a first desired implement configuration based on the objective map, determines a second optimal implement configuration based on the first desired configuration and a defined snow quality value. The processing unit further displays information, or operates, or makes the implement work based on the second determined optimal configuration.

33 Claims, 4 Drawing Sheets

(58) Field of Classification Search
CPC .... B62D 55/244; B62D 55/30; B62D 55/305; F25C 3/00
See application file for complete search history.

(56) References Cited

FOREIGN PATENT DOCUMENTS

| | | | |
|---|---|---|---|
| EP | 3633107 | A1 | 4/2020 |
| WO | 0116560 | A2 | 3/2001 |

* cited by examiner

SNOW GROOMER VEHICLE AND METHOD OF CONTROLLING A SNOW GROOMER VEHICLE

CROSS-REFERENCE TO RELATED APPLICATIONS

This patent application claims priority from Italian Patent Application No. 102020000011272 filed on May 15, 2020, the entire disclosure of which is incorporated herein by reference.

TECHNICAL FIELD

This invention relates to a snow groomer vehicle and a method of controlling a snow groomer vehicle.

BACKGROUND ART

As is well known, the preparation of ski slopes requires ever-increasing care, both for safety reasons and because modern equipment can be used much better on surfaces that are regular, free of marked roughness, and with as homogeneous a bottom as possible. On the other hand, the creation of so-called snow parks is also spreading in many areas. Snow parks are confined, fenced areas equipped with facilities for performing tricks, such as kicker and landing ramps of various configurations and difficulties, humps, boxes, rails, half-pipes, and so on. The snowpack is processed using snow groomer vehicles, which are equipped with special tools for this purpose. In particular, a snow groomer vehicle generally comprises a front blade and a rear tiller and trimmer. The blade can be lifted, lowered, and oriented to move desired amounts of snow, which can then be removed, accumulated, distributed, and shaped as required. The rear implement with tiller and trimmer, on the other hand, enables the desired finish of the snowpack surface to be achieved.

However, the quality of the preparation of both the slopes and the snow park facilities is currently largely entrusted to the skill and experience of the snow groomer vehicle operators, who have almost complete control over the work implements. The results obtained, which are obviously influenced by a significant subjective component, can scarcely, therefore, be repeated and cannot be easily optimised. This may result, on the one hand, in uneven conditions, beyond what objective environmental factors would allow, and, on the other, in a greater expenditure of time and resources because the treatment steps are not carried out optimally.

Instead, greater uniformity of results would be desirable, especially to make up for the more limited skills of less experienced operators.

DISCLOSURE OF INVENTION

The purpose of this invention is to provide a snow groomer vehicle and a method of controlling a snow groomer vehicle that makes it possible to overcome, or at least to mitigate, the limitations described.

According to this invention, a snow groomer vehicle is therefore provided, in accordance with one of the claims from 1 to 17.

With this invention, an operator can be assisted during their operations to perform optimal work on ski slopes. In particular, they can be assisted using a screen on which the optimal configuration of the at least one implement is displayed for the operator to then implement, or the processing unit directly implements the optimal configuration of the at least one implement automatically. This ensures a better result for the snowpack treatment and one that is less dependent on the experience of the snow groomer operator.

Finally, this system can also be equipped with an automatic driving module to make the snow groomer vehicle totally autonomous both in defining the path and in defining the configuration of one or more implements.

According to another aspect of the invention, a method of controlling a snow groomer vehicle, according to claims 18 to 31, is also provided.

BRIEF DESCRIPTION OF THE DRAWINGS

Further features and advantages of this invention will be apparent from the following description of non-limiting embodiments thereof, with reference to the figures of the accompanying drawings, wherein.

BEST MODE FOR CARRYING OUT THE INVENTION

Figure 1:
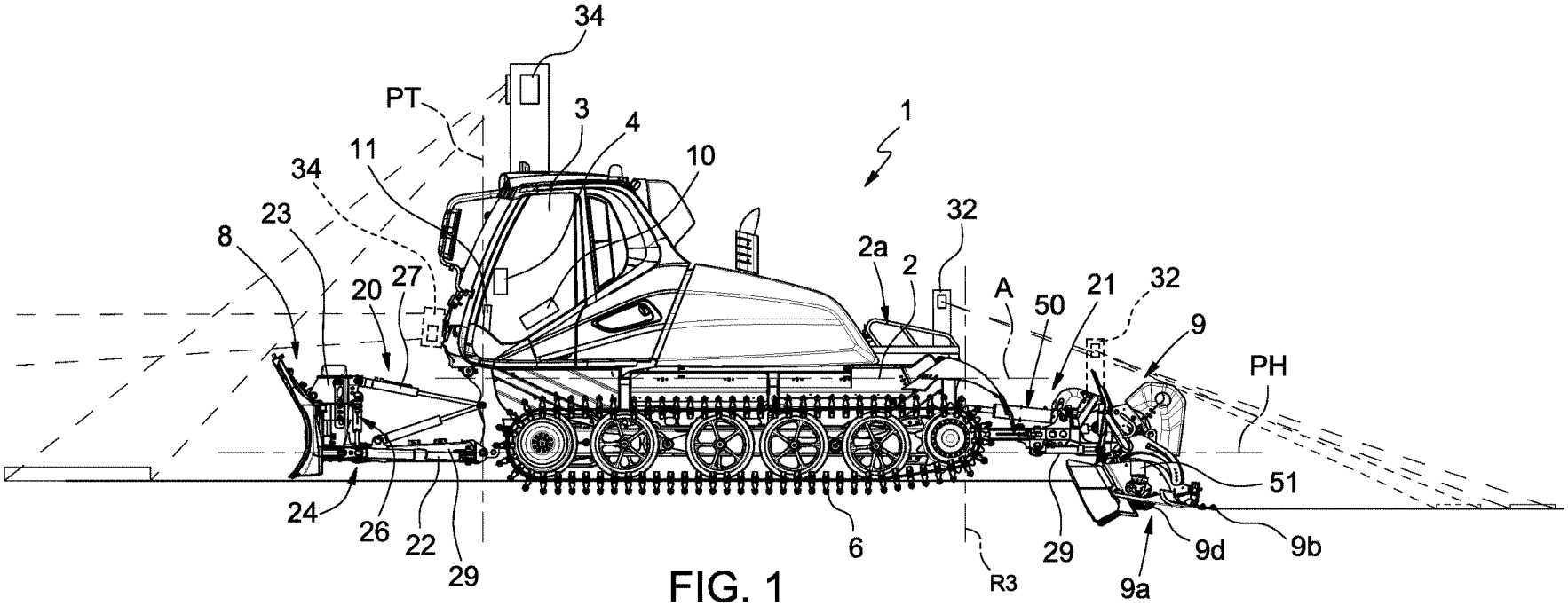
FIG. 1 is a side view of a snow groomer vehicle in accordance with an embodiment of this invention.
Figure 2:
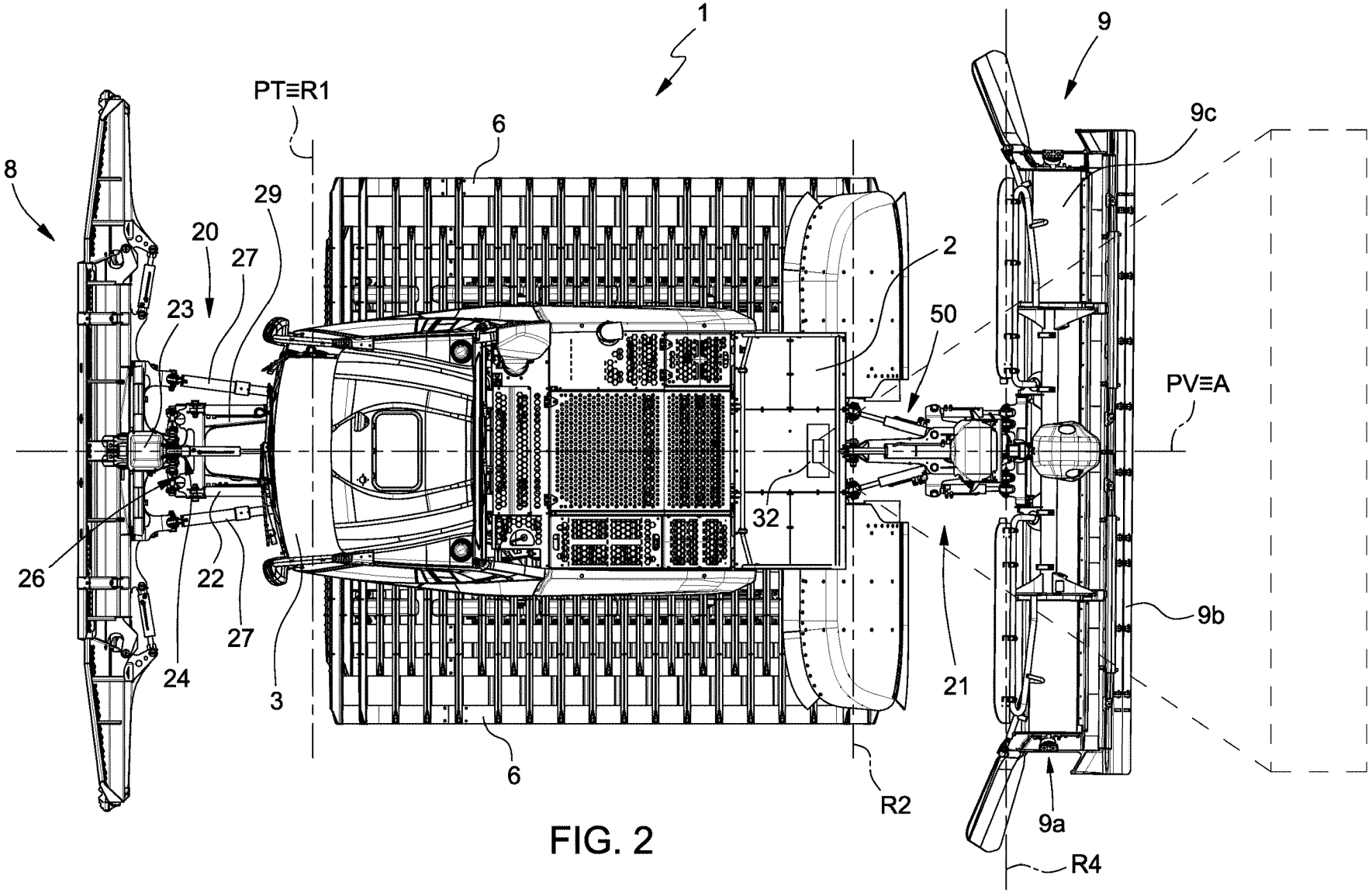
FIG. 2 is a plan view from above of the snow groomer vehicle in FIG. 1.
Figure 3:
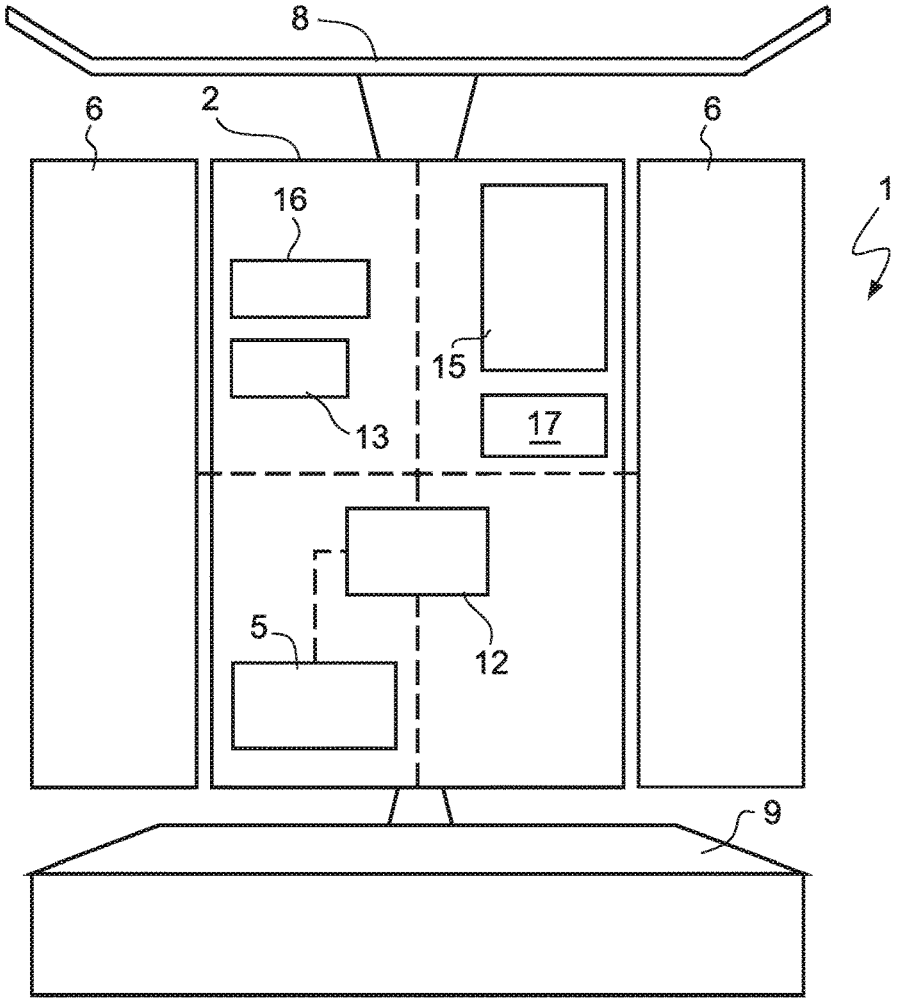
FIG. 3 is a simplified block diagram of the snow groomer vehicle in FIG. 1.

With reference to FIGS. 1-3, a snow groomer vehicle according to one embodiment of this invention is referred to as a whole by the number 1 and comprises a frame 2, which extends along a longitudinal axis A (FIG. 2), a driver's cab 3, and a drive unit 5 (FIG. 3), e.g., an internal combustion engine. The driver's cab 3 and the drive unit 5 are housed on the frame 2. The snow groomer vehicle 1 is, in addition, equipped with a pair of tracks 6 and user devices, including a blade 8, supported at the front by the frame 2, and a tiller assembly 9 comprising a tiller 9*a* and, preferably, a trimmer 9*b*, supported at the rear by the frame 2. There may also be a winch assembly not shown here. A power transmission 12 (FIG. 3) is operatively coupled to the drive unit 5, which provides the power necessary for the operation of the snow groomer vehicle 1, and to the user devices, also called implements. The power transmission 12 can be hydraulic or electric or a combination of both. The drive unit 5 may be an electric motor with a rechargeable battery instead of an internal combustion engine. Alternatively, the drive unit 5 may be a hybrid engine comprising an internal combustion engine and an electric motor connected in series or in parallel. In another embodiment, the drive unit 5 may be a hydrogen-powered fuel-cell engine.

The tiller 9*a*, in particular, comprises a rotating shaft 9*d* provided with teeth and a protective casing 9*c* that is arranged above the rotating shaft 9*d*. The area between the protective casing 9*c* and the rotating shaft 9*d* is called the working chamber and is configured to have a variable volume. In particular, the tiller 9*a* comprises a device for varying the distance between the rotating shaft 9*d* and the protective casing 9*c*; in this way, the volume of the working chamber can be adjusted. This device may act on the rotating shaft 9*d*, modifying its position, or may act on the protective casing 9*c*, modifying its position. Varying the working chamber results in a different tilling of the treated snowpack.

A user interface, which enables an operator to control the movement of the snow groomer vehicle 1 and the operation of the user devices, is installed in the driver's cab 3.

In particular, the snow groomer vehicle 1 comprises the user interface that, in turn, comprises a forward command 10 for the snow groomer vehicle 1 in order to control the direction and speed of movement of the tracked vehicle 1. In particular, the forward command 10 controls the movement of the tracks 6 to define the direction and speed of movement of the tracked vehicle 1.

In addition, the snow groomer vehicle 1 comprises the user interface that, in turn, comprises a drive command 11 for the user devices, in particular the drive command 11 controls the user devices.

In particular, the drive command 11 controls the pressure of the tiller 9*a* on the snowpack, and/or the position and/or the cutting angle of the tiller 9*a*, and/or a working chamber of the tiller 9*a*, and/or the speed and/or the direction of rotation of the shaft 9*d* of the tiller assembly 9, in particular of the tiller 9*a*.

In one embodiment, the tiller 9*a* comprises two shafts connected to each other via a coupling. In this embodiment, the drive command 11 also controls the relative position of the two shafts.

In addition, the drive command 11 controls the position of the blade 8.

In a non-limiting embodiment, the tracked vehicle 1 comprises the interface that in turn comprises a display screen 4 that is configured to display information regarding the tracked vehicle 1 and the user devices.

The snow groomer vehicle 1 is provided with a satellite navigation device 13 and a control system 15.

Figure 4:
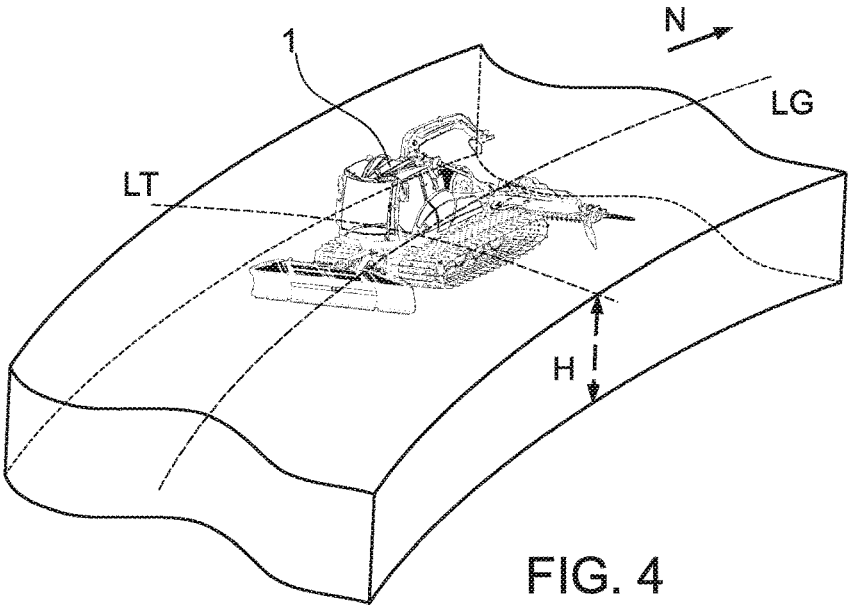
FIG. 4 shows coordinates that can be detected using a component of the snow groomer vehicle in FIG. 1.

The satellite navigation device 13, for example a GNSS ("Global Navigation Satellite System") device, is configured to determine, with accuracy in the order of centimetres, its own three-dimensional position and orientation and, consequently, the three-dimensional position and orientation of the snow groomer vehicle 1. In practice, the satellite navigation device 13 enables the determination of longitude LG, latitude LT, and height above ground H, as well as the direction of a reference axis (FIG. 4). The height above ground H corresponds to the thickness of the snowpack at the coordinates of the satellite navigation device 13 and of the snow groomer vehicle 1. The height above ground H, in particular, may be determined by the difference between an elevation detected by the satellite navigation device 13 and a ground elevation defined by a reference map at a corresponding longitude LG and latitude LT. The reference map may be created using the satellite navigation device 13 in the absence of snow and stored in the satellite navigation device 13 or the control system 15. In the first case, the height H above ground is provided directly by the satellite navigation device 13; in the second case, the satellite navigation device 13 may provide an elevation in relation to a reference elevation (such as sea level) and the height H above ground is determined by the control system 15 using the reference map.

The control system 15 detects operating parameters of the snow groomer vehicle 1, such as, for example, but not limited to, the power delivered by the drive unit, the power absorbed by each of the user devices, the position of the blade 8 and of the tiller assembly 9, or the forward speed of the snow groomer vehicle 1.

In addition, the control system 15 also detects operating parameters relating to the pressure of the tiller 9*a* on the snowpack and/or the position and/or cutting angle of the tiller 9*a* relative to the snowpack and/or a working chamber of the tiller 9*a* and/or the speed and direction of rotation of the shaft of the tiller assembly 9, in particular of the tiller 9*a*.

The control system 15 is equipped with wireless connection capabilities, such as directly through a local communication network or through a mobile data network and an internet connection, for connection to a ski resort resource management system, not shown here.

The blade 8 is connected to the frame 2 by means of a front connecting device 20, while the tiller assembly 9 is connected to the frame 2 by means of a rear connecting device 21.

The front connecting device 20 comprises two rigid structures 22 and 23. The rigid structure 22 is hinged to the frame 2, so that it can rotate around a horizontal rotational axis (when the snow groomer vehicle 1 is level) and parallel to the plane of the tracks 6. The rigid structure 23 is fixed to the blade 8 and is coupled to the rigid structure 22 by means of a universal joint 24, in particular a universal spherical joint.

The front connecting device 20 additionally comprises:

- at least one first actuator for rotating the rigid structure 22 about the rotational axis R1 and raising and lowering the blade 8;
- second actuators 26 to rotate the blade 8 (vertical inclination or tilt), in practice creating a difference in height between the right and left ends of the blade 8 with respect to the plane of the tracks 6;
- at least one third actuator 27 for determining the forward inclination or incidence angle of the blade 8 (cutting angle); and
- fourth actuators for orienting the blade 8, in practice arranging the blade 8 itself perpendicularly or obliquely to the forward direction of the snow groomer vehicle 1 (lateral inclination or tilt).

The drive command 11 is configured to control the front connecting device 20, is housed in the cab 3, and enables the four movements described to be combined. The four movements described define the operating parameters of the blade 8.

The rear connecting device 21 comprises a rigid structure 29 hinged to the frame 2 in a pivoting manner about a rotational axis R2 (FIG. 2) that is horizontal (when the snow groomer vehicle 1 is level) and parallel to the plane of the tracks 6 (parallel to a plane PH) and to a rotational axis R3 (FIG. 1). The rotational axis R3 is perpendicular to the other rotational axis R2 and belonging to a longitudinal plane PV (FIG. 2) that divides the snow groomer vehicle 1 longitudinally into two basically symmetrical parts. In addition, the rear connecting device 21 supports the tiller assembly 9 in a pivoting manner about a rotational axis R4 that is horizontal when the snow groomer vehicle 1 is level.

With reference to FIGS. 1 and 2, the rear connecting device 21 also comprises an actuator assembly 50 (FIG. 2) for: raising and lowering the tiller assembly 9 by rotating the rigid structure 29 (FIG. 1) about the rotational axis R2; orienting the tiller assembly 9, in practice by arranging the tiller 9*a* itself perpendicular or obliquely with respect to the forward direction of the snow groomer vehicle 1 itself; and translating the tiller assembly 9 laterally with respect to the frame 2; and controlling one or more of the following quantities: the relative angular position of the tiller assembly 9 with respect to the rear rigid structure 21 (cutting angle) and/or the snowpack; the position of the tiller 9 with respect to the rear rigid structure 21 and/or the snowpack; the pressure of the tiller 9 with respect to the rear rigid structure 21 and/or the snowpack.

In addition, the tiller assembly 9 comprises at least one actuator assembly 51 that can be operated to control one or more of the following quantities: speed and/or a direction of rotation of the shaft 9*d* of the tiller 9*a*; a volume of a working chamber of the tiller 9*a*.

The drive command 11 is configured to control the front connecting device 21 and the actuator assemblies 50 and 51 of the tiller assembly 9. This drive command 11 is housed in the cab 3 and enables the four movements described to be combined in order to adjust the pressure of the tiller 9*a* on the snowpack and/or the position and/or the cutting angle of the tiller 9*a*.

In addition, the drive command 11 makes it possible to adjust the speed and/or direction of rotation of the shaft 9*d* of the tiller 9*a* and to define a volume of the working chamber of the tiller 9*a*.

The operating parameters of the tiller assembly 9 are: the pressure of the implement 8, 9 on the snowpack; the relative position of the implement 8, 9 relative to the frame 2; the cutting angle of the implement 8, 9 relative to the snowpack; the speed and/or direction of rotation of the implement 8, 9; and the working chamber of the implement 8, 9, in particular of the tiller assembly 9.

In one embodiment, the drive command 11 to control the blade 8, in particular the front connecting device 20, and the drive command 11 to control the tiller assembly 9, in particular the actuator assemblies 50 and 51 of the tiller assembly 9 and the rear connecting device 21, are generally defined by a single manual control device that is a joystick with a lever and a series of mini-levers and buttons on the lever.

In a manual or assisted control mode, the front connecting device 20, the rear connecting device 21, and the actuator assemblies 50 and 51 of the tiller assembly 9 are controlled by the operator using the joystick lever, the mini-levers, and the buttons. In greater detail, the movements and operating configurations of the blade 8 and the tiller assembly 9 are defined based on the lever movements and the combination of mini-levers and buttons that are thrown/pushed.

The snow groomer vehicle 1 comprises at least one first detection device 32 selected from the device assembly: a LIDAR, a radar, an infrared video camera, an infrared camera, a camera, and a video camera.

In one embodiment, the LIDAR is of the 360° type.

In one embodiment, the snow groomer vehicle comprises a group of first detection devices comprising a number of first detection devices wherein each first detection device is selected from the device assembly: a LIDAR, a radar, an infrared video camera, an infrared camera, a camera, and a video camera.

The first detection device 32 is located in a rear area of the snow groomer vehicle 1 and is housed and configured so as to frame a surface of the external environment behind the snow groomer vehicle 1, preferably a portion of the snowpack behind the snow groomer vehicle 1 and over which the snow groomer vehicle 1 has passed.

In addition, the first detection device 32 is configured to provide data relating to the areas of the surface behind the snow groomer vehicle 1 and framed by said first detection device 32. In particular, the first detection device 32 may provide images or video of the surface behind the snow groomer vehicle, or raw and/or processed data representing the framed surface behind the snow groomer vehicle.

For example, the first detection device 32 may be a video camera installed on the tiller 9*a*, which frames the external surface behind the tracked vehicle 1 in particular the snowpack behind and following the passage of the snow groomer vehicle 1. This video camera may also be installed in an area behind the snow groomer vehicle 1, for example, in an area behind the frame 2 for example on a rear support structure 2*a* fixed between the two last wheels of the tracks according to the forward direction. Said video camera may be a video camera or a camera operating with natural or artificial ambient light or infrared light. In one embodiment, the video camera is connected to a light source that targets the same surface framed by the video camera.

In addition, the video camera can be replaced by a LIDAR system or they can be used in combination. The LIDAR system will also be housed and configured to frame the exterior surface behind the snow groomer vehicle 1, in particular a surface of the snowpack behind and following the passage of the snow groomer vehicle 1.

The snow groomer vehicle 1 comprises at least one second detection device 34 selected from the device assembly: a LIDAR, a radar, an infrared video camera, an infrared camera, a camera, and a video camera.

In one embodiment, the snow groomer vehicle 1 comprises a group of second detection devices 34 comprising a number of second detection devices 34 wherein each second detection device is selected from the device assembly: a LIDAR, radar, an infrared video camera, an infrared camera, a camera, and a video camera.

The second detection device 34 is located in a front portion of the snow groomer vehicle 1 and is housed and configured to frame an area of the exterior environment in front of the snow groomer vehicle 1, preferably a portion of the snowpack or ground in front of the snow groomer vehicle 1 and on which the snow groomer vehicle 1 has not yet passed and is configured to provide data based on the processing of the areas of the environment in front of the snow groomer vehicle 1 framed by said device.

For example, the second detection device 34 may be a video camera installed above the cab 3 and that frames the external surface in front of the snow groomer vehicle 1, in particular the snowpack in front of and preceding the passage of the snow groomer vehicle 1. This video camera may also be installed in another front portion of the snow groomer vehicle 1, for example in a lower inner or outer part of the cab 3. Said camera may be a video camera or a camera operating with natural or artificial ambient light or infrared light. In one embodiment, the video camera is connected to a light source that targets the same surface framed by the video camera.

In addition, the video camera can be replaced by a LIDAR system or they can be used in combination. The LIDAR system will also be housed and configured to frame the exterior surface in front of the snow groomer vehicle 1.

In one embodiment, either the satellite navigation device 13 or the second detection device 34 may be omitted.

In addition, the user devices, in particular the blade 8, using the actuators 25-28, and the tiller and trimmer assembly 9, using the actuators 50 and 51, can be automatically controlled by the control system 15.

Figure 5:
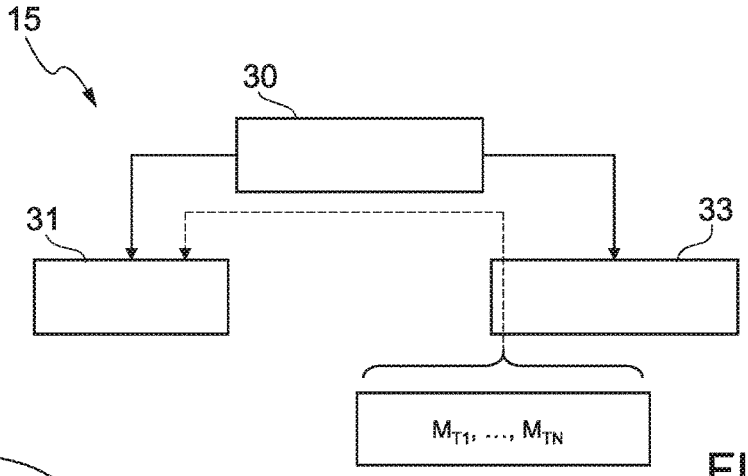
FIG. 5 is a more detailed block diagram of a control system for the snow groomer vehicle in FIG. 1.
Figure 6:
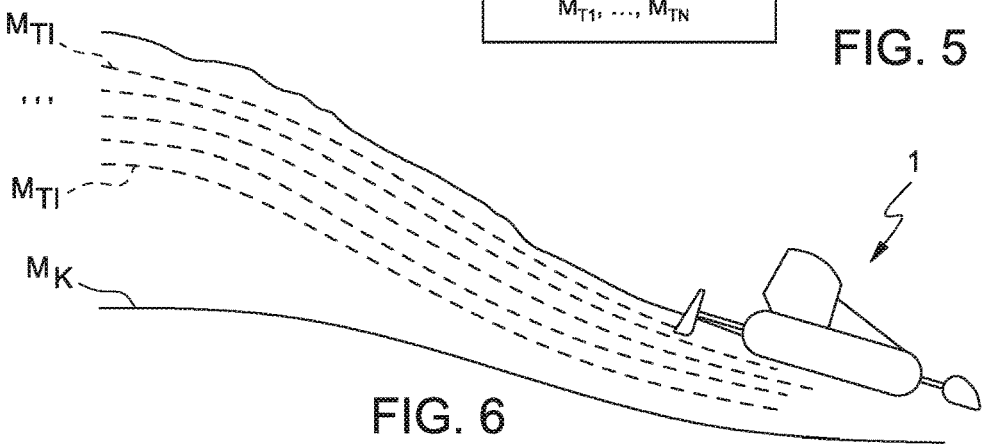
FIG. 6 is a schematic representation of stored maps.
Figure 7:
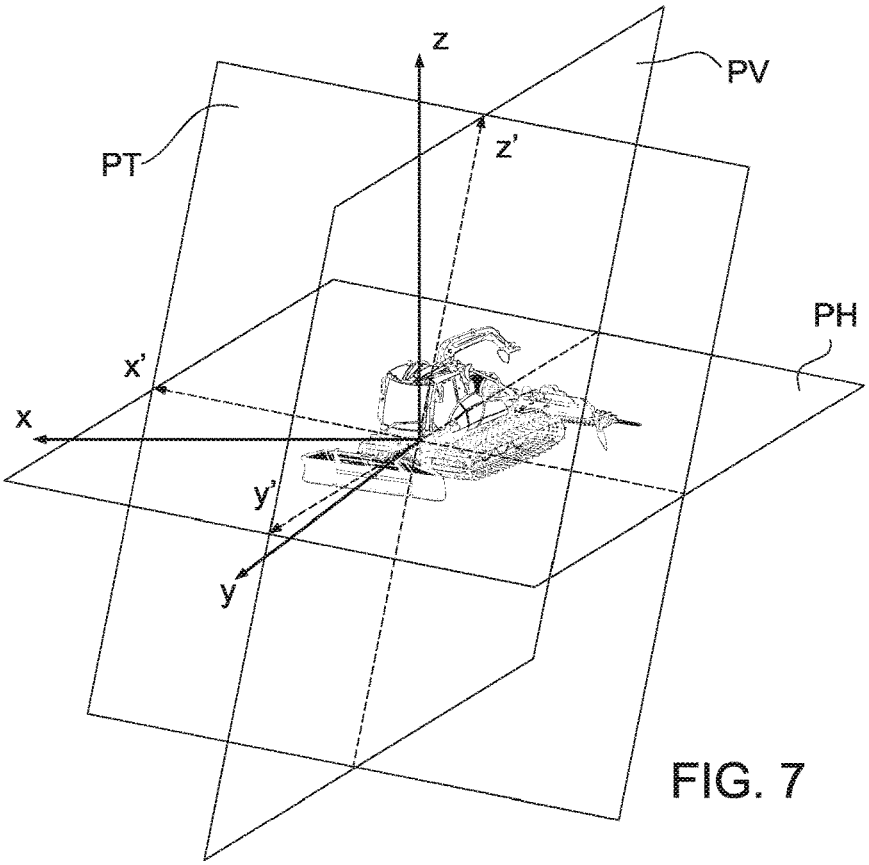
FIG. 7 shows reference systems and plans used in one embodiment of the control method according to this invention.

For this purpose, the control system 15 in one embodiment comprises a processing unit 30, a memory device 31, and a communication interface 33 (FIG. 5).

In one alternative embodiment, the memory device 31 is included in the satellite navigation device 13.

The processing unit 30 is coupled to the satellite navigation device 13 to receive position data from the snow groomer vehicle 1 and is configured to process the data from the satellite navigation device 13 and select an objective map relating to the desired snow treatment.

The objective maps can represent both the ideal surface of a ski slope, normally characterised by surface regularity and uniformity of consistency of the pack, and the surface of a snowpark structure, with a special shape. In addition, the objective maps $M_{T1}, \ldots, M_{TN}$ may represent objective surfaces intermediate between a current objective surface and the current snowpack surface in the area to be treated. In practice, especially for snowpark structures, which can be particularly complex, the processing of the snow surface can be carried out repeatedly.

In this embodiment, the objective maps $M_{T1}, \ldots, M_{TN}$ may be produced in a remote computer center and loaded into the memory device 31 via the communication interface 33 or they are sent to the processing unit 30 in real time via a radio data link.

In particular, the processing unit 30 selects one of the objective maps based on the position detected by the satellite navigation device 13. In one embodiment, the processing unit 30 selects one of the objective maps based on the position detected by the satellite navigation device 13 and based on a user command relating to a desired map on a subset of objective maps identified by the processing unit 30 based on the detected position.

In one embodiment, the desired map is selected by a remote operator who sends it to the snow groomer vehicle 1, instead of by the user control.

In one alternative embodiment to the previous one, the processing unit 30 is coupled to the second detection device 34 to receive data relating to the areas of the environment in front of the snow groomer vehicle 1 and is configured to process data from at least the second detection device 34 and define an objective map relating to the desired snow treatment. In this embodiment, an objective map is calculated or selected based on data relating to the area of the environment in front of the snow groomer vehicle 1 received from the second detection device 34. In particular, in this embodiment of this invention, the processing unit 30 defines an objective map using the data received from the at least second detection device 34.

In the two embodiments illustrated above, the processing unit 30 processes the objective maps using data received from the satellite navigation device 13 or data received from the at least second detection device 34.

In another embodiment, the processing unit 30 is connected to both the second detection device 34 and the satellite navigation system 13 and processes the objective map using data received from the satellite navigation device 13 and of the at least second detection device 34.

In one embodiment, the processing unit 30 is configured to define at least one first desired implement configuration, preferably the blade 8 and/or the tiller assembly 9, based on data received from the satellite navigation device 13 and/or the second detection device 34 so that the passage of the implement causes a change in the snowpack according to a desired conformation.

In particular, the processing unit 30 is configured to define at least one first desired implement configuration, preferably the blade 8 and/or the tiller assembly 9, based on the objective map processed so that the passage of the implement causes the snowpack to change according to a desired conformation.

The implement configuration comprises at least parameter values of desired movements and/or rotations and/or positions of the implement, for example the implement configuration comprises positions of the blade 8 to be implemented via the first actuator assembly 22-26 or positions of the tiller assembly 9 and/or speed of rotation of the tiller assembly 9*a* and/or a volume of the working chamber of the tiller assembly 9 to be implemented via the second actuator assembly 50 and 51.

In particular, the configuration of the tiller assembly 9 comprises one or more of the quantities relating to the following parameters: the pressure of the tiller assembly 9 on the snowpack; the relative position of the tiller assembly 9 with respect to the frame 2; the cutting angle of the tiller assembly 9 with respect to the snowpack; the speed and/or the direction of rotation of the tiller assembly 9; the working chamber of the tiller assembly 9.

Accordingly, the first desired implement configuration, in particular of the blade 8, comprises desired positions of the blade 8 that are to be implemented via the first actuator assembly 22-26 so that the passage of the implement causes the snowpack to change according to a desired conformation.

Accordingly, the first desired implement configuration, in particular of the tiller assembly 9, comprises positions of the tiller assembly 9 and/or speed and/or the direction of rotation of the tiller 9*a* and/or the value of the working chamber of the tiller assembly 9 and/or the pressure of the tiller assembly 9 on the snowpack and/or the cutting angle of the tiller assembly 9 with respect to the snowpack, which are to be implemented by means of the second actuator assembly 50 and 51 so that the passage of the implement causes the snowpack to change according to a desired conformation.

In one embodiment, the processing unit 30 defines a first desired configuration of the blade 8 and a first desired configuration of the tiller assembly 9.

The processing unit 30 is coupled with the at least first detection device 32 to receive data relating to areas of the environment behind the snow groomer vehicle 1 and is configured to process the data from the at least first detection device 32 and define an at least second optimal implement configuration, preferably the blade 8 and/or the tiller assembly 9, based on the data received from the first detection device 32 so that the passage of the implement causes the snowpack to change according to an optimal conformation.

In particular, the processing unit 30 is coupled to the at least first detection device 32 to receive data relating to the areas of the environment behind the snow groomer vehicle 1 and is configured to process data from the at least first detection device 32 and define a snow quality value.

The processing unit 30 is configured to determine a second optimal implement configuration on the basis of the first desired implement configuration and on the basis of the defined snow quality value.

In a preferred, non-limiting embodiment of this invention, the processing unit 30 comprises a first processing module comprising a neural network configured to receive image data as input and to output a snow quality value. In particular, the image data are the data relating to the areas of the environment behind the snow groomer vehicle 1 provided by the first detection device 32.

In particular, this neural network is a convolutional neural network (also known by the term CNN or ConvNet). In a preferred embodiment, the convolutional neural network of the first processing module is an Alexnet convolutional neural network.

The first processing module is configured to define the snow quality value. In particular, the first processing module was trained using a series of images of various snow finishes. More specifically, the neural network comprises a series of layers, wherein the first layer, which also defines the input layer, is configured to accept input images and the last layer, which also defines the output layer, is configured to provide as output a snow quality value.

In particular, said neural network is trained to recognise various snow finishes through a training process in which a number of images of the snow finish are given as input and in which the corresponding snow quality value finish is indicated. Subsequently, said neural network is tested with a second number of snow images to test whether the training was successful, i.e. whether said neural network trained in this way provides as output the correct snow quality values based on the images given as input. After the training and testing phase, said neural network is implemented in the first processing module and, consequently, in the processing unit 30.

In a preferred, non-limiting embodiment of this invention, the processing unit 30 comprises a second processing module comprising a neural network configured to receive as input the snow quality value, in particular defined by the first processing module, and to provide as output the parameter values of the second optimal implement configuration. In addition, the second processing module receives as input the current configuration of the operating assembly and corresponding configuration parameters and the operating parameters of the snow groomer vehicle 1.

In particular, this neural network is a neural network configured to operate via reinforcement learning following a first initial learning.

In a preferred embodiment, the neural network of the second processing module comprises a number of layers wherein the first layer, which defines the input layer, is configured to receive a number of inputs equal to the number of outputs of the last layer of the neural network of the first processing module preferably in addition to the parameters of actual configuration of the implement. In other words, the number of outputs of the last layer of the neural network of the first processing module is equal to the number of inputs of the first layer of the neural network of the second processing module preferably in addition to the parameters of the actual configuration of the implement.

The neural network of the second processing module is trained to define the values of the second optimal configuration based on the quality parameter preferably defined by the first processing module via continuous learning that may be performed using at least one of the following two approaches:

1) It continuously varies the values of the second optimal configuration according to a rule and detects the results of the quality parameter value, if this variation results in an improvement of the quality parameter values then it continues to vary the values of the second optimal configuration with said rule, otherwise it changes said rule or uses a different rule until a rule or the changed rule results in an improvement of the quality parameter values.
2) When the operator acts on the actuator assembly—either to modify the automatic control, or during the semi-automatic control, or during the manual control—it detects the changes that the operator implements on the actuator assembly and detects the snow treatment quality parameter resulting from said operator changes. If the snow treatment quality parameter falls within a range of acceptable values, it changes one or more rules by also recording the vehicle operating parameters and coupling them to it. This occurs, in particular, if the values of the second optimal configuration that the second processing module would have defined or defined are different from the values of the configuration that the operator implemented.

These rules that are continuously updated via continuous learning and/or reinforcement learning may be sent to a remote unit via a preferably wireless data connection.

In addition, via a remote unit you can supervise these rules and said learning process and you can change said rules. In addition, if there is a fleet of snow groomer vehicles, it is possible to average the changed rules of each vehicle and control said rules of each vehicle remotely through continuous learning via the remote unit.

Continuous and/or reinforcement learning has the effect of adapting the control of the operating assembly to the different types of snow in different ski resorts.

In one embodiment of this invention, the satellite navigation device 13 and/or the second detection device 34 may be omitted. In this embodiment, the control system 15, in particular the processing unit 30, is not configured to define the first desired implement configuration 8, 9. In this embodiment, the processing unit 30, in particular the second processing module, is configured to define the second optimal configuration based on the snow quality value defined by the first processing module and based on the values of the snow groomer vehicle 1 and on the current values relating to at least one of the following quantities: pressure of the implement 8, 9 on the snowpack; the relative position of the implement 8, 9 relative to the frame 2; the cutting angle of the implement 8, 9 relative to the snowpack; the speed and/or direction of rotation of the implement 8, 9; the working chamber of the implement 8, 9, in particular of the tiller assembly 9. In other words, in one embodiment of this invention the second optimal configuration is defined based on the data from the first detection device 32 and via the neural networks of the first processing module and the second processing module, in particular without using the data from the second detection device 34 and/or the satellite detection device 13 and/or the first desired configuration.

In one embodiment, the snow groomer vehicle comprises a weather data receiver 16. In this embodiment, the processing unit 30 is connected in communication with the weather data receiver 16, and is configured to determine the desired second optimal configuration based on the weather data received from the weather data receiver 16, depending on the first desired implement configuration and depending on the defined snow quality value.

In one embodiment, the processing unit 30 is configured to determine the first desired configuration based on weather data received from the weather data receiver 16.

In one embodiment alternative to or in combination with the preceding, the snow groomer vehicle 1 comprises at least one of the following sensors: a temperature sensor for detecting air temperature, a temperature sensor for detecting snow temperature, at least one humidity sensor for detecting air humidity, a sensor for determining snow density and the amount of water in the snow. In this embodiment, the processing unit 30 is configured to determine the first desired configuration and/or the second optimal configuration based on data received from at least said sensor and/or weather data receiver 16.

The second optimal implement configuration, in particular of the blade 8, is the configuration that comprises optimal positions of the blade 8 that are to be implemented via the first actuator assembly 22-26 so that the passage of the implement causes the snowpack to change according to a desired conformation.

The second optimal implement configuration, in particular of the tiller assembly 9, is the configuration that comprises optimal positions of the tiller 9*a* and/or the optimal speed and/or direction of rotation of the shaft 9*d* of the tiller 9*a* and/or the optimal value of the working chamber of the tiller assembly 9 and/or the optimal pressure of the tiller assembly 9 on the snowpack and/or the optimal cutting angle of the tiller assembly 9 with respect to the snowpack, which are to be implemented by means of the second actuator assembly 50 and 51 so that the passage of the implement causes the snowpack to change according to a desired conformation.

The difference between the first desired implement configuration and the second optimal implement configuration is that the first desired implement configuration is defined on the basis of the objective maps that, in turn, are defined on the basis of the data of the satellite navigation device and/or the second detection device 34, whereas the second optimal configuration is defined on the basis of the first desired configuration and the snow quality value, i.e. it detects the state of the snow actually processed and changes the parameters according to the actual result obtained by processing the snow. In other words, the second optimal configuration is given by feedback on the snow treatment actually processed.

In one embodiment, the processing unit 30 is configured to send information of the second optimal implement configuration to the display screen 4 so as to suggest to the operator how to act on the implement 8, 9 so as to cause the implement 8, 9 to work in the determined second optimal configuration to obtain an optimal snowpack layer.

In another embodiment, the processing unit 30 is configured to control the actuator assembly 25-28 and 50, 51 and/or the rotation speed of the implement and/or the working chamber of the implement and/or the pressure of the implement 8, 9 on the snowpack and/or the relative position of the implement 8, 9 relative to the frame 2 and/or the cutting angle of the implement 8, 9 relative to the snowpack and/or the speed and/or direction of rotation of the implement 8, 9 and/or the working chamber of the implement 8, 9 so that the implement 8, 9 works in the second optimal configuration determined to obtain an optimal snowpack layer.

The first desired implement configuration, in particular of the blade 8, for driving (among others) the actuators 25-28 of the blade 8 can be determined by the processing unit 30 on the basis of objective maps $M_{T1}, \ldots, M_{TN}$ stored in the memory device 31 and representing desired surfaces to be obtained from the snowpack treatment.

The snow groomer vehicle 1 comprises an automatic driving module that is connected in communication with the processing unit 30 to receive and send data with the processing unit 30.

In addition, the automatic driving module is connected in communication with the first and second detection devices 32 and 34 to receive data from said devices and is configured to define a trajectory to be travelled based on the data from the first and second detection devices 32 and 34.

In addition, the automatic driving module is connected in communication with the satellite position detection device 13 and is configured to define the trajectory to be travelled based on the data from the first and second detection devices 32 and 34.

For example, the processing unit 30 may use information from the sensors to recognise the presence of fixed obstacles (terrain irregularities, trees, rocks, slopes, pylons, snow cannons, protective nets, and the like) or moving obstacles (for example, skiers) along the trajectory of the snow groomer vehicle 1 and to react with appropriate actions: stopping the snow groomer vehicle, deviating from the set trajectory, changing the configuration of the blade or the tiller and trimmer assembly.

In one optional embodiment, the tiller assembly comprises tracking devices for defining cross-country ski tracks. For example, the tiller assembly is of the type illustrated in WO 2017/175193, wherein the tiller assembly comprises a main tiller and one or more tracking devices connected to the main tiller. Each tracking device comprises a plate with blades that sink into the snowpack and are configured to define tracks in the snowpack for cross-country skiing. In addition, each tracking device may comprise an auxiliary tiller arranged between the plate and the main tiller. In this embodiment, the actuator assembly can also be operated to control at least one of the following quantities: the position of the tracking device, in particular of the plate; the pressure of the tracking device in the snow, in particular of the plate; the rotation speed; the cutting angle of the auxiliary tiller.

In this embodiment, the first desired implement configuration may also comprise parameter values relating to at least one of the following quantities: the position of the tracking device, in particular of the plate; the pressure of the tracking device in the snow, in particular of the plate; the rotation speed; the cutting angle of the auxiliary tiller.

In this embodiment, the second optimal implement configuration, in particular of the tiller assembly 9, may also comprise the configuration of one or more of the following quantities: the position of the tracking device, in particular of the plate; the pressure of the tracking device in the snow, in particular of the plate; the rotation speed; the cutting angle of the auxiliary tiller which must be implemented via the actuator assembly so that the passage of the implement causes the snowpack to change according to a desired conformation.

In a preferred embodiment, one or more of the following parameters: the position of the tracking device, in particular of the plate; the pressure of the tracking device in the snow, in particular of the plate; the rotation speed; the cutting angle of the auxiliary tiller which are to be implemented via the actuator assembly so that the passage of the implement causes the snowpack to change according to a desired conformation, are defined via the data of the first detection device and the neural networks of the first processing module and the second processing module, in particular without using the second detection device and/or the satellite navigation device and/or the first desired configuration.

As illustrated above and depending on the different embodiments, the snow groomer vehicle 1 may be configured to be used in one or more of the following operation modes: a first, preferably fully autonomous operation mode; a second, preferably partially autonomous operation mode; a third, preferably assisted operation mode.

The vehicle is equipped with instrumentation and control devices that basically enable autonomous operation in the first operation mode. In other words, in the first fully autonomous operation mode, the vehicle autonomously defines the path to be followed, avoids obstacles, and operates the user devices automatically by defining all the operating parameters.

In the second operation mode, the vehicle 1 is driven by an operator as far as regards the path to be taken while the user devices operate automatically; in other words, the vehicle automatically defines the operating parameters of the user devices. In one embodiment, the vehicle automatically defines the operating parameters of the tiller assembly while the blade is operated by the user.

In the third operation mode, the vehicle is driven entirely by the operator, both in terms of the path to be followed and in terms of how to operate the user devices. In this embodiment, the vehicle is configured to show the parameters of the second optimal configuration of at least one of the user devices, preferably the tiller assembly, on a screen inside the cab so as to assist the operator when using the snow groomer vehicle.

The invention claimed is:

1. A snow groomer vehicle comprising:

a frame extending along a longitudinal axis (A);

at least one implement connected to the frame by a connecting device, wherein at least one implement is selected from a group of implements consisting of: a blade and a tiller assembly;

at least one actuator assembly operable to control at least one of the following quantities: a pressure of the implement on a snowpack; a relative position of the implement relative to the frame; a cutting angle of the implement relative to the snowpack; a speed and/or direction of rotation of the implement; a working chamber of the implement;

at least one first detection device selected from a group consisting of: a LIDAR, a radar, an infrared video camera, an infrared camera, a camera and a video camera; wherein the at least one first detection device is located at a rear portion of the snow groomer vehicle and is housed and configured to frame areas of an environment behind the snow groomer vehicle comprising a portion of the ground behind the snow groomer vehicle and over which the snow groomer vehicle has passed, and is configured to define data by processing the areas of the environment behind the snow groomer and framed by the at least one first detection device;

a control system comprising a processing unit at least being coupled to the at least one of the first detection device to receive data relating to the areas of the environment behind the snow groomer vehicle and configured to process data from at least one of the first detection device and define at least one snow quality value;

the processing unit being configured to determine a second optimal implement configuration depending on the at least one defined snow quality value, wherein the implement configuration comprises at least parameter values relating to at least one of the quantities; and the processing unit being configured to perform at least one of the following two actions:

sending to a display screen information of the second optimal implement configuration to suggest to at least one operator how to act on the implement;

adjusting the actuator assembly for controlling the parameter values relating to the at least one of the quantities so that the implement works in the determined second optimal implement configuration, wherein the processing unit comprises a first processing module comprising a convolutional neural network configured to receive as input data from the first detection device regarding images of the areas of the environment behind the snow groomer and framed by the first detection device; and provide as output the at least one snow quality value.

2. The snow groomer vehicle of claim 1, comprising: at least one satellite navigation device and/or at least one second detection device selected from the group consisting of: a LIDAR, a radar, an infrared camera, an infrared camera, a camera and a video camera, wherein the at least one second detection device is located in a front portion of the snow groomer vehicle and is housed and configured to frame the areas of the environment in front of the snow groomer vehicle and is configured to define data by processing the areas of the environment in front of the snow groomer vehicle and framed by said device;

the processing unit being coupled with the at least one satellite navigation device to receive data from the at least one satellite navigation device and/or from the at least one second detection device to receive data regarding the areas of the environment in front of the snow groomer vehicle and configured to process the data from the at least one satellite navigation device and/or from the at least the second detection device (34) and define an objective map of a desired snow treatment;

the processing unit being configured to define at least one first desired implement configuration based on the defined objective map in such a way that a passage of the implement causes the snowpack to change according to a desired conformation;

the processing unit (30) being configured to determine the second optimal implement configuration on the basis of the first desired implement configuration and of the at least one defined snow quality value.

3. The snow groomer vehicle according to claim 1, wherein the processing unit (30) comprises a second processing module comprising a neural network configured to receive as input the at least one snow quality value and a current configuration of the implement, and to provide, as output, the second optimal configuration.

4. The snow groomer vehicle according to claim 1, comprising a user interface including a control device to receive commands from the at least one operator related to an operator configuration of the implement; the processing unit being coupled to the control device to receive commands from the at least one operator and being configured to determine the second optimal configuration of the implement according to operator commands.

5. The snow groomer vehicle according to claim 1, comprising a user interface including the display screen to display an implement configuration; the user interface being coupled to the processing unit to receive and display on the display screen the second optimal implement configuration in order to suggest to the at least one operator how to act on the implement.

6. The snow groomer vehicle of claim 1, including a satellite navigation device; wherein the processing unit is connected in communication with the satellite navigation device and is configured to:

determine a position and orientation of the frame using data provided by the satellite navigation device;

receive data related to the position and orientation of the frame and define an objective map related to a desired snowpack treatment;

define the first desired configuration based on the position and orientation of the frame.

7. The snow groomer vehicle according to claim 6, including a weather data receiver wherein the processing unit is connected in communication with the weather data receiver, and is configured to determine the first desired configuration and/or the second optimal configuration based on the weather data received from the weather data receiver.

8. The snow groomer vehicle according to claim 6, wherein the control system and/or the satellite detection device includes a memory device, comprising a terrain map;

and wherein the processing unit is configured to define the first desired configuration based on the terrain map data.

9. The snow groomer vehicle according to claim 6, wherein the processing system is configured to receive and/or define a snow depth data and the processing system is configured to define the first desired configuration based on the snow depth data.

10. The snow groomer vehicle according to claim 1, wherein the at least one implement is the tiller assembly; the at least first detection device is located on the tiller assembly or on a rear portion of the snow groomer vehicle and is configured to frame a surface area behind the snow groomer vehicle on which the tiller assembly has acted; wherein the processing unit is configured to process the second optimal configuration based on the input data of the first detection device.

11. The snow groomer vehicle according to claim 1, wherein at least the second detection device is located on the blade and is configured to frame the surface in front of the snow groomer vehicle on which the blade is to act; wherein the processing unit is configured to process the first desired configuration based on the data of the second detection device.

12. The snow groomer vehicle according to claim 1, wherein the second detection device is located on the snow groomer vehicle; wherein at least the second detection device is configured to frame the surface in front of the snow groomer vehicle on which the blade is to act; wherein the processing unit is configured to process the first desired configuration based on the data of the second detection device.

13. The snow groomer vehicle of claim 1, including an autonomous driving module; the autonomous driving module is coupled in communication to receive data from the first detection device and the second detection device; the autonomous driving module implements the desired path based on the data from the first detection device and the second detection device.

14. The snow groomer vehicle of claim 1, in which the second detection device is configured to detect the snow profile and/or detect objects and/or obstacles and/or people.

15. The snow groomer vehicle according to claim 1, wherein the implement includes a blade connected to the frame and the connecting device includes a front connecting device connecting the blade to the frame; the front connecting device comprises a front rigid structure hinged to the frame in a pivoting manner around a front rotational axis (R1) and a universal joint connecting the blade to the front rigid structure and in which the actuator assembly comprises: a first actuator unit configured to rotate the front rigid structure around the front rotational axis (R1) to raise and lower the blade; a second actuator unit configured to rotate the blade creating a difference in level between opposite blade ends; a third actuator unit configured to determine a forward inclination of the blade; and a fourth actuator unit configured to orient the blade perpendicular or oblique to a forward direction.

16. The snow groomer vehicle according to claim 1, wherein the implement includes the tiller assembly and the connecting device includes a rear connecting device connecting the tiller assembly to the frame.

17. A method to control a snow groomer vehicle, the snow groomer vehicle including:

a frame extending along a longitudinal axis (A); and at least one implement connected to the frame by a connecting device, wherein at least one implement is selected from a group of implements consisting of: a blade and a tiller assembly;

at least one actuator assembly operable to control at least one of the following quantities: a pressure of the implement on a snowpack; a relative position of the implement relative to the frame; a cutting angle of the implement relative to the snowpack; a speed and/or direction of rotation of the implement; a working chamber of the implement;

at least one first detection device selected from a group consisting of: a LIDAR, a radar, an infrared video camera, an infrared camera, a camera and a video camera; wherein the at least one first detection device is located at a rear portion of the snow groomer vehicle and is housed and configured to frame areas of an environment behind the snow groomer vehicle, and over which the snow groomer vehicle has passed, and is configured to define data by processing the areas of the environment behind the snow groomer and framed by the at least one first detection device;

the method comprising:

receiving the data relating to the areas of the environment behind the snow groomer vehicle, processing the data from the at least the first detection device and defining a snow quality value;

determining a second optimal implement configuration depending on the defined snow quality value, wherein the implement configuration comprises at least parameter values relating to at least one of the quantities; and performing at least one of the following two actions:

sending to a display screen, information of the second optimal implement configuration to suggest to at least one operator how to act on the implement;

adjusting the actuator assembly to define at least parameter values relating to at least one of the quantities so that the implement works in the second determined optimal implement configuration;

the method comprises a first a convolutional neural network algorithm configured to receive as input data from the at least one first detection device regarding images of the areas of the environment behind the snow groomer and framed by the at least one first detection device; and provide as output the snow quality value.

18. The method of claim 17, wherein the snow groomer vehicle comprises at least one satellite navigation device and/or at least one second detection device selected from the group consisting of: a LIDAR, a radar, an infrared video camera, an infrared camera, a camera and a video camera; wherein the at least one second detection device is located in a front portion of the snow groomer vehicle and is housed and configured to frame the areas of the environment in front of the snow groomer vehicle, and is configured to define data based on the processing of the areas of the environment in front of the snow groomer vehicle framed by said device;

the method comprising the following steps:

receiving data from the at least one satellite navigation device and/or receiving data from the areas of the environment in front of the snow groomer vehicle from the at least one second detection device;

processing data from the at least one satellite navigation device and/or from the at least one second detection device and defining an objective map of the desired snow treatment;

defining at least one first desired implement configuration based of the defined objective map in such a way that a passage of the implement causes the snowpack to change according to a desired conformation;

determining the second optimal implement configuration depending on the at least one first desired implement configuration and the defined snow quality value.

19. The snow groomer vehicle according to claim 17, wherein the method comprises a second neural network algorithm configured to receive as input the snow quality value, and the current configuration of the implement, and to provide, as output, the second optimal configuration.

20. The method of claim 17, comprising the steps of:

receiving operator commands and determining the second optimal implement configuration according to the operator commands.

21. The method according to claim 17, including receiving and displaying on a display screen of the snow groomer vehicle the second optimal implement configuration in order to suggest to the at least one operator how to act on the implement.

22. The method of claim 17, comprising:

determining a position and orientation of the frame using data provided by the at least one satellite navigation device;

receiving data on the position and orientation of the frame and defining an objective map of the desired snowpack treatment; and defining the at least one first desired configuration based on the position and orientation of the frame.

23. The method according to claim 17, including determining the at least one first desired configuration and/or the second desired optimal configuration based on weather data received from a weather data receiver.

24. The method according to claim 17, including defining the at least one first desired configuration based on terrain map data stored in a memory.

25. The method according to claim 17, including receiving a snow depth data regarding to a measure of a snow depth, and defining the at least one first desired configuration based on the snow depth data.

26. The method according to claim 17, wherein the at least one implement is the tiller assembly; the at least one first detection device is located on the tiller assembly or on a rear portion of the snow groomer vehicle; the method includes framing by the at least one first detection device the surface behind the snow groomer vehicle on which the tiller assembly has acted; and processing the second optimal configuration based on the data of the first detection device.

27. The method according to claim 17, wherein the snow groomer vehicle includes a blade; wherein at least one second detection device is located on the blade; the method includes framing with at least one second detection device the surface in front of the snow groomer vehicle on which the blade is to act; and processing the at least one first desired configuration based on the data of the at least one second detection device.

28. The method according to claim 17, wherein the second detection device is located on the snow groomer vehicle; the method includes framing with the second detection device the surface in front of the snow groomer vehicle on which the blade is to act; and processing the at least one first desired configuration based on the data of the at least one second detection device.

29. The method according to claim 17, the method comprising steps of independently defining a path to be followed for the snow groomer vehicle based on the data of the at least one first detection device and the at least one second detection device.

30. The method of claim 17 further comprising a step of using a computer program configured to run in a snow groomer vehicle processing unit to implement the method steps.

31. The method of claim 30 further comprising a step of using a readable memory device on which is stored the computer program.

32. A method to control a snow groomer vehicle, the snow groomer vehicle including:

a frame extending along a longitudinal axis (A); and at least one implement connected to the frame by a connecting device, wherein at least one implement is selected from a group of implements consisting of: a blade and a tiller assembly;

at least one actuator assembly operable to control at least one of the following quantities: a pressure of the implement on a snowpack; a relative position of the implement relative to the frame; a cutting angle of the implement relative to the snowpack; a speed and/or direction of rotation of the implement; and a working chamber of the implement;

at least one first detection device selected from a group consisting of: a LIDAR, a radar, an infrared video camera, an infrared camera, a camera and a video camera; wherein the at least one first detection device is located at a rear portion of the snow groomer vehicle and is housed and configured to frame areas of environment behind the snow groomer vehicle and over which the snow groomer vehicle has passed, and is configured to define data by processing the areas of the environment behind the snow groomer and framed by the at least one first detection device;

the method comprising:

receiving the data relating to the areas of the environment behind the snow groomer vehicle, processing the data from the at least the first detection device and defining a snow quality value;

determining a second optimal implement configuration depending on the defined snow quality value, wherein the implement configuration comprises at least parameter values relating to the at least one of the said quantities; and performing at least one of the following two actions:

sending to a display screen the information of the second optimal implement configuration in order to suggest to at least one operator how to act on the implement;

adjusting the actuator assembly to define the at least one of the said quantities so that the implement works in the second determined optimal implement configuration;

wherein the method including determining at least one first desired configuration and/or the second desired optimal configuration based on weather data received from a weather data receiver.

33. The method according to claim 32, including receiving a snow depth data regarding to a measure of the snow depth, and defining the at least one first desired configuration based on the snow depth data.

* * * * *